United States Patent [19]

Wada et al.

[11] 4,451,228

[45] May 29, 1984

[54] BURNER

[75] Inventors: Chuzoh Wada, Nara; Yoshikazu Matsuda, Sakurai; Yoshio Asano, Nara, all of Japan

[73] Assignee: Matsushita Electric Industrial Co., Ltd., Kadoma, Japan

[21] Appl. No.: 379,879

[22] Filed: May 19, 1982

[30] Foreign Application Priority Data

May 20, 1981 [JP] Japan ..... 56-77177
Jun. 3, 1981 [JP] Japan ..... 56-86076

[51] Int. Cl.[3] ..... F23N 5/00

[52] U.S. Cl. ..... 431/76; 431/32; 431/3; 431/14; 126/96

[58] Field of Search ..... 431/35, 33, 32, 76, 431/3, 121, 4, 14, 15, 17; 236/15 E; 126/96, 97, 45, 92 AC

[56] References Cited

U.S. PATENT DOCUMENTS 2,363,443 11/1944 Shagaloff ..... 126/96 X
4,392,813 7/1983 Tanaka et al. ..... 431/76

*Primary Examiner*—Samuel Scott

*Assistant Examiner*—Randall L. Green

*Attorney, Agent, or Firm*—Stevens, Davis, Miller & Mosher

[57] ABSTRACT

A burner of wick type is disclosed which secures user safety by stopping combustion through an oxygen depletion protection function in the event of an oxygen depletion. When tar is accumulated in the wick, the wick is burnt to clean the tar with the liquid fuel supply cut off, thus burning out the liquid fuel contained in the wick. In the process, the combustion temporarily becomes unstable and a great amount of carbon monoxide is generated, resulting in a state similar to oxygen depletion. In a burner with an oxygen depletion protection function, the combustion is stopped during the wick cleaning, with the result that most of the tar accumulated in the wick remains unburnt, adversely affecting both the fuel absorption characteristic and service life of the wick. This invention is such that the oxygen depletion protection function is not operated during the wick cleaning. The tar accumulated in the wick is mostly burnt out and thus the deterioration of the fuel absorption characteristic is prevented thereby improving the service life of the wick.

3 Claims, 4 Drawing Figures

BURNER

The present invention relates to a burner of wick type which protects against oxygen depletion in indoor air.

Generally, after a long use of a burner, particularly, an indoor open type burner the oxygen concentration of the indoor air decreases so that the indoor air runs short of oxygen and begins to be filled with carbon monoxide. A proposal has so far been made to provide the burner with an oxygen depletion protection device for stopping combustion by detecting oxygen depletion or a change of electrical current or a concentration of carbon monoxide in the combustion flame caused by the oxygen depletion.

In the case where the oxygen depletion protection device is added to a wick type burner, however, the problem is that it is impossible to perform what is called "wick cleaning" for removing tar from the wick by combustion with a supply of liquid fuel cut off. The wick cleaning causes unstable combustion and temporarily generates a great amount of carbon monoxide, thereby leading to a condition similar to oxygen depletion. As a result, during wick cleaning, the oxygen depletion protection device is activated to stop the combustion, thereby making impossible the wick cleaning. When the burner of wick type is provided with the oxygen depletion protection device, therefore, the wick cleaning of tar attached to the wick cannot be performed, with the result that the absorption characteristic of the wick is deteriorated thereby to shorten the service life of the burner.

Accordingly, it is an object of the present invention to provide a burner in which the wick cleaning is made possible by suspending the operation of the oxygen depletion protection device during wick cleaning.

According to the present invention, there is provided a burner of wick type in which it is possible to effect wick cleaning by burning out the liquid fuel contained in the wick with liquid fuel supply cut off, so that the tar accumulated in the wick is removed by the cleaning thereby lengthening the service life of the wick.

An embodiment of the present invention will be described below with reference to the accompanying drawings, in which FIG. 1 is a longitudinal sectional view schematically showing a burner according to an embodiment of the present invention;

Figure 1:
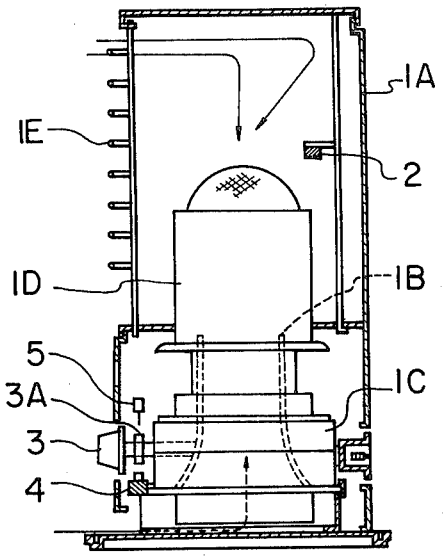

In FIG. 1, the inner lower part of a boxshaped body case 1A with the upper front part thereof open is provided with a fuel tank 1C having a vertically movable cylindrical wick 1B. A chimney 1D is removably disposed on the fuel tank 1C for burning the fuel vaporized from the wick 1B. The chimney 1D is positioned at the inner upper part of the body case 1A to radiate the radiation heat in forward direction through a guard 1E provided at the open part of the front of the body case 1A. A sensor 2 made of such a material as tin oxide is for detecting an oxygen depletion at or in the vicinity of the part above the chimney 1D. The sensor 2 is for detecting the combustion state of the burner depending on the oxygen concentration in the room, the tar attached to the wick 1B or the concentration of carbon monoxide during combustion.

Figure 2:
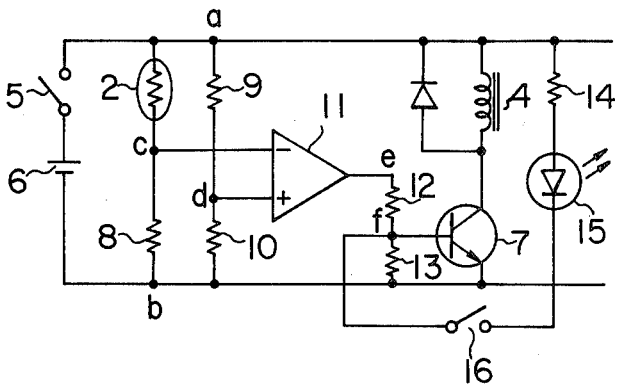
FIG. 2 is an electrical circuit diagram of the burner shown in FIG. 1.

This burner or stove is so constructed that when a knob 3 is turned clockwise, a cam 3A is fixed by an electromagnet 4 while at the same time closing a switch 5. As shown in FIG. 2, a closed loop is formed of a DC power supply 6, the switch 5, a junction a, the electromagnet 4, a transistor 7 and a junction b. Between junctions a and b, the sensor 2 and a resistor 8 are connected in series through a junction c, and resistor 9 and 10 through a junction d. The junctions c and d are connected to the positive and negative input terminals of a differential amplifier 11. The output terminal e of the differential amplifier 11 is connected in series with resistors 12 and 13 through a junction f, which is in turn connected to the base of the transistor 7. Between the junctions a and f, a resistor 14, a light-emitting diode 15 (which may be replaced with equal effect by another alarm means such as a buzzer) and a switch 16 are inserted.

In this configuration, turning the knob 3 clockwise raises the wick 1B for ignition so that the combustion flame produced from the chimney ID is detected by the sensor 2. The knob 3 is fixed by the electromagnet 4 while at the same time closing the switch 5 to supply current to the circuit. When current disappears from the electromagnet 4, the holding of the cam 3A by the electromagnet 4 is cancelled and the knob 3 is restored to its original position thereby lowering the wick 1B for quenching the flame.

The junction d is fixed at a certain potential by the closing of the switch 5. Since the sensor 2 detects a normal combustion, however, the resistance value of the sensor 2 is considerably high, so that the potential at junction c is reduced lower than the potential at junction d. As a result, the output of the differential amplifier 11 is raised to high state, and the transistor 7 begins to conduct. The electromagnet 4 holds the cam 3A to fix the knob 3 to continue the combustion. Under this condition, assuming that the oxygen depletion deteriorates the combustion state, the resistance value of the sensor 2 is reduced so that the potential at junction c exceeds that of junction d. The differential amplifier 11 and the transistor 7 are turned off thereby cancelling the holding of the cam 3A by the electromagnet 4. The knob 3 is released and the wick 1B is lowered thereby to quenching the flame.

In the case where the wick 1B of this burner or stove is to be cleaned, the liquid fuel in the fuel tank 1C, is burned out without being supplied with fuel. In the process, the combustion becomes so unstable that carbon monoxide in the combustion flame increases. As a result, the resistance value of the sensor 2 decreases and the potential at the junction c rises thereby to turn off the electromagnet 4 as mentioned above. If the switch 16 is closed before the wick cleaning, the transistor 7 is kept conducting, thus making it possible to hold the cam 3A and the knob 3 by the electromagnet 4. Under this condition, the light-emitting diode 15 included in the present embodiment also emits light. In this way, as soon as the switch 16 is closed, the lamp (light-emitting diode) 15 is lit thereby to inform the user that the oxygen depletion protection device is not working.

Figure 3:
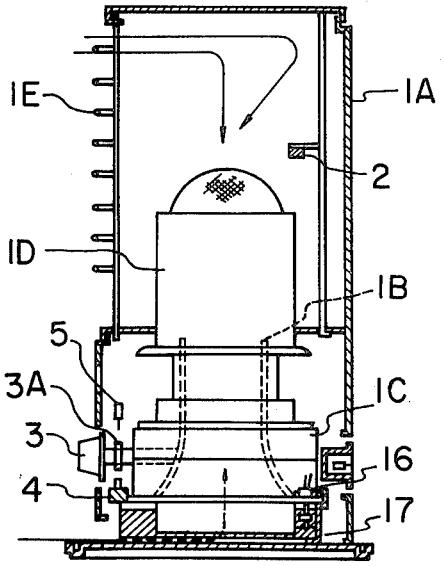
FIG. 3 is a longitudinal sectional view schematically showing a burner according to another embodiment of the present invention.

FIG. 3 shows another embodiment in which the switch 16 can be closed automatically. In this embodiment, the switch 16 is comprised of an oil level sensor for detecting the oil level in the fuel tank 1C. When liquid fuel such as kerosene is consumed and the oil level lowers, the switch 16 is turned on. When the supply of liquid fuel to the fuel tank IC is stopped (by removing a cartridge tank not shown) and combustion continues, the liquid fuel is automatically consumed, so that the oil level lowers and the switch 16 is turned on thereby to automatically effect the wick cleaning. According to the embodiment under consideration, the switch 16 is connected in series with the light-emitting diode 15 used as alarm means, which light-emitting diode 15 emits light to inform the user that the burner is in an automatic wick cleaning condition. Another advantage of this construction is that the user is informed of the decrease in liquid fuel by the lighting of the light-emitting diode 15 even if he forgets to replenish the fuel.

Figure 4:
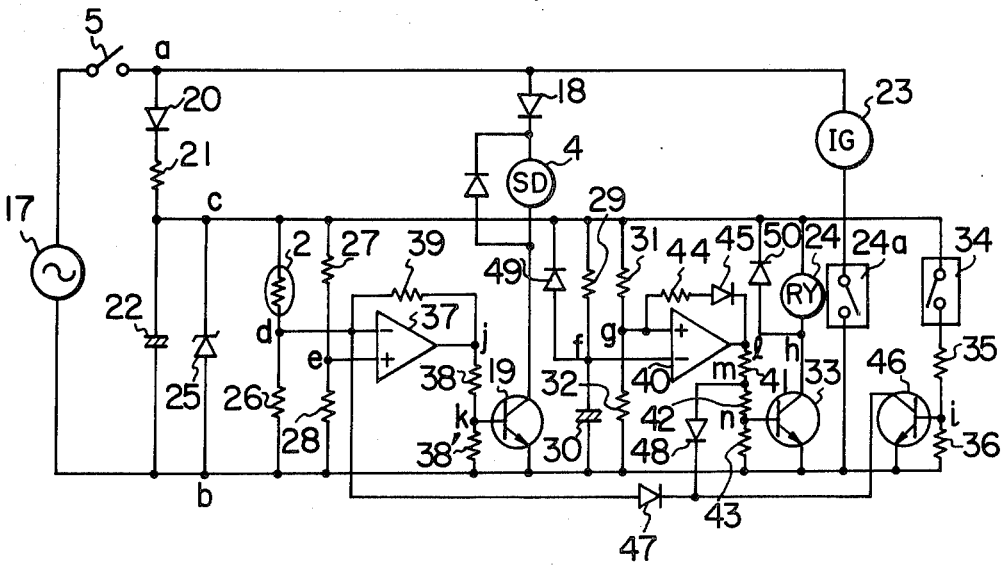
FIG. 4 is an electrical circuit diagram showing another embodiment of the control circuit.

An electrical circuit for further improving the safety of the burner is shown in FIG. 4. This circuit prevents the user from performing the wick cleaning unless he is conscious of this particular action. Specifically, in the wick cleaning, where the wick is burnt with liquid fuel supply thereto cut off, the wick 1B already contains liquid fuel and continues to be burnt until the liquid fuel therein is consumed entirely. This combustion normally continues for about 30 minutes to one hour, during which obnoxious carbon monoxide continues to be generated. Unless the user takes care of ventilation or the like bearing this fact in mind, a dangerous situation is likely to result. The embodiment under consideration takes this fact into consideration.

A circuit configuration of this embodiment will be described. The circuit includes an AC power supply 17, a switch 5, a junction a, a diode 18, an electromagnet 4, and a transistor 19 and a junction b making up a closed loop. Between the junctions a and b, a series circuit including a diode 20, a resistor 21, a junction c and a capacitor 22 is connected in parallel with another series circuit including an ignitor 23 and a contact 24*a* of a relay 24. Between the junctions c and b, on the other hand in parallel with the capacitor 22; a Zener diode 25; a first series circuit including a sensor 2, a junction d and a resistor 26; a second series circuit including a resistor 27, a junction e and a resistor 28; a third series circuit including a resistor 29, a junction f and a capacitor 30; a fourth series circuit including a resistor 31, a junction g and a resistor 32; a fifth series circuit including a relay 24, a junction h and a transistor 33; and a sixth series circuit including a switch 34, a resistor 35, a junction i and a resistor 36 are all connected in parallel to one another. In the circuit portion between junctions c and b, the positive and negative input terminals of a first differential amplifier 37 are connected with the junctions e and d. A series circuit including a resistor 38, a junction k and a resistor 38' is inserted between the junction b and the output j of the first differential amplifier 37, while a resistor 39 is connected between junctions d and j, and the base of the transistor 19 is connected to the junction k. The positive and negative inputs of a second differential amplifier 40 are connected with the junctions g and f. A series circuit including a resistor 41, a junction m, a resistor 42, a junction n and a resistor 43 is inserted between the output l of the differential amplifier 40 and the junction b; a resistor 44 and a diode 45 with the cathode thereof on junction l side is inserted between junctions g and l; and the base of the transistor 33 is connected to the junction n. The junction i is connected to the base of the transistor 46 the emitter of which is connected to the junction b and the collector thereof to the anodes of the diodes 47 and 48 from the junctions d and m respectively. The junctions f and h are connected to diodes 49 and 50 respectively with the cathodes thereof connected to the junction c.

The operation of this circuit will be described. Turning the knob 3, the cam 3A and the knob 3 are fixed by the electromagnet 4 and the switch 5 is closed, supplying a voltage between the junctions a and b. This voltage is applied between the junctions c and b through the diode 20 and the resistor 21, thus generating a DC voltage by the Zener diode 25 and the capacitor 22. In response to this voltage, the sensor 2 detects that the oxygen concentration is high. Because of a large resistance value, the potential at junction d is lower than that at junction e. Since the potential at junction j is at high state, the transistor 19 is turned on and the knob 3 is fixed by the electromagnet 4. When an oxygen depletion occurs, however, the resistance value of the sensor 2 lowers and therefore the potential at junction d exceeds that at junction e, so that the electromagnet 4 is de-energized without producing an output. The knob 3 is restored to its original position and the wick 1B lowers thereby to extinguish the flame.

As long as the potential at junction f determined by the resistor 29 and the capacitor 30 approaches the potential at junction g, the output of the differential amplifier 40 is kept at a high state so that the contact 24*a* of the relay 24 is closed to operate the ignitor 23. When the potential at junction f concides with that at junction g, the differential amplifier 40 and the transistor 33 are turned off, and the relay 24 is deenergized thereby to stop the ignitor 23. This process takes about one minute.

Apart from the normal operation mentioned above, the liquid fuel is required to be discharged from the tank IC during the wick cleaning. This discharging operation is performed by separate means.

Assume that the switch 34 for effecting the wick cleaning is closed under normal state of combustion. The transistor 46 is turned on, and the cathodes of the diodes 47 and 48 are grounded. The diode 47 causes the differential amplifier 37 to produce a high at the output j. The transistor 19 is turned on, and thus the electromagnet 4 keeps the knob 3 fixed, thus making combustion possible. This process is accomplished regardless of the resistance value of the sensor 2. The junction m is grounded through the diode 48 and the transistor 33 is turned off, thus making the ignitor 23 inoperable. In other words, in order to effect wick cleaning during normal combustion, the switch 34 is required to be closed during normal combustion, whereby the user comes to know of the wick cleaning. In the case where the switch 34 is already closed and the user closes the operating switch 5 without knowledge of the wick cleaning, the ignitor 23 fails to operate and the combustion does not start. In this case, the switch 34 is opened and closed again after the ignition operation and therefore, the user becomes conscious of the wick cleaning.

Although the foregoing embodiment concerns an oil stove, the same effect is attained by a burner in the form of a hot-air heater having a fan. Also, the sensor for detecting an oxygen depletion may detect the flame current instead of the oxygen concentration or carbon monoxide.

It will be understood from the foregoing description that according to the present invention, in the event that an oxygen depletion occurs during normal combustion, an oxygen depletion protection function works to extinguish the flame, thereby improving the safety against the oxygen shortage. Further, since this oxygen depletion protection function does not work during the wick cleaning, the tar accumulated on the wick can be burnt out, thus maintaining an always superior fuel absorption characteristic.

What is claimed is:

1. A burner comprising:

a wick;

means for raising said wick to a combustion position and for lowering said wick to an extinguishing position;

holding means for holding said wick raised to said combustion position, said wick being ignitable at said combustion position;

protection means for protecting against continuing combustion in the presence of oxygen depletion, said protection means detecting a change in combustion state which occurs upon oxygen depletion and releasing the holding of said wick by said holding means upon detecting said change in state; and switch actuatable wick cleaning means for permitting the holding of said wick in said combustion position by said holding means by preventing said protection means from releasing the holding of said wick, said switch actuatable wick cleaning means being actuated when a fuel tank of said burner is empty and allowing the combustion of said wick to be maintained until the fuel contained in said wick is consumed.

2. A burner according to claim 1, wherein said switch actuatable wick cleaning means includes alarm means for announcing that said protection means for oxygen depletion is prevented from releasing the holding of said wick.

3. A burner according to claim 1 or 2, wherein said burner further comprises ignition means for automatically igniting said wick when said wick is raised to said combustion position, and said switch actuatable wick cleaning means controls an ignition preventing means for preventing a supply of power to said ignition means when said wick cleaning means is actuated to ensure that said wick cleaning means is actuated only after said wick is brought into a combustion state.

* * * * *